US005295650A

United States Patent [19]

Brandt

[11] Patent Number: 5,295,650

[45] Date of Patent: Mar. 22, 1994

[54] ADJUSTABLE BEVERAGE HOLDER FOR A FOLDING LOUNGE CHAIR

[76] Inventor: Beverly F. Brandt, 2152 Ili Ili Rd. #202, Kihei, Maui, Hi. 96753

[21] Appl. No.: 3,006

[22] Filed: Jan. 11, 1993

[51] Int. Cl.[5] ..... A47K 1/08

[52] U.S. Cl. ..... 248/311.2; 108/26; 297/194

[58] Field of Search ..... 248/150, 153, 311.2, 248/310; 224/42.45 R, 42.46 R, 275; 297/194, 188; 108/26

[56] References Cited

U.S. PATENT DOCUMENTS

| | | | |
|---|---|---|---|
| 2,706,138 | 4/1955 | Luce et al. | 108/26 |
| 3,913,878 | 10/1975 | Wayne | 248/311.2 |
| 4,063,701 | 12/1977 | Wray | 297/188 X |
| 4,131,259 | 12/1978 | Franks | 248/311.2 |
| 4,535,923 | 8/1985 | Manke | 224/42.45 R X |
| 4,575,149 | 3/1986 | Forestal | 297/194 |
| 4,629,153 | 12/1986 | Marcum | 224/42.45 R X |
| 4,727,890 | 3/1988 | Vincent | 248/311.2 X |
| 4,878,642 | 11/1989 | Kirby | 248/311.2 |
| 4,948,197 | 8/1990 | Sansing | 297/194 |
| 4,997,156 | 3/1991 | Allen | 297/188 X |

*Primary Examiner*—J. Franklin Foss
*Attorney, Agent, or Firm*—Michael I. Kroll

[57] ABSTRACT

An adjustable beverage holder is provided for a folding lounge chair which consists of an arm, a fastener for removably attaching a first end of the arm to the folding lounge chair, a beverage receptacle and a mechanism for coupling in an adjustable manner the beverage receptacle to a second end of the arm opposite from the removable attaching fastener. A beverage container placed within the beverage receptacle will be maintained in a steady upright position with respect to the folding lounge chair to prevent spillage from the beverage container.

11 Claims, 2 Drawing Sheets

10
14
58
20
60
64
96
16
24
44
51
18
68
66
78
76
70
74
66a
51a
72
76
74

96
24
60
56
16
64
14
58
46
20
44
68
58
66
14
78
70
76
74
24
16
62
64
14
96
78
72
66
76
74

14
14
56
28
16
54
46
44
30
24
26
14
20
32
94
14

14
32
30
56
82
98
84
16
92
28
90
80
88
20
26
86
44
24
94

ADJUSTABLE BEVERAGE HOLDER FOR A FOLDING LOUNGE CHAIR

BACKGROUND OF THE INVENTION

1. Field of the Invention

The instant invention relates generally to beverage retaining devices and more specifically it relates to an adjustable beverage holder for a folding lounge chair.

2. Description of the Prior Art

Numerous beverage retaining devices have been provided in prior art that are adapted to engage with beverage containers, so as to keep them stabilized to prevent the spillage of the liquid contents therefrom. While these units may be suitable for the particular purpose to which they address, they would not be as suitable for the purposes of the present invention as heretofore described.

SUMMARY OF THE INVENTION

A primary object of the present invention is to provide an adjustable beverage holder for a folding lounge chair that will overcome the shortcomings of the prior art devices.

Another object is to provide an adjustable beverage holder for a folding lounge chair that can be clamped to an armrest of the chair, so that a beverage container can be maintained in a steady upright position with respect to the chair to prevent spillage.

An additional object is to provide an adjustable beverage holder for a folding lounge chair, that can be clamped to a frame of a backrest on an armless chair, so as to substitute for an armrest as well as support the beverage container in a steady upright position with respect to the chair to prevent spillage.

A further object is to provide an adjustable beverage holder for a folding lounge chair that is simple and easy to use.

A still further object is to provide an adjustable beverage holder for a folding lounge chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
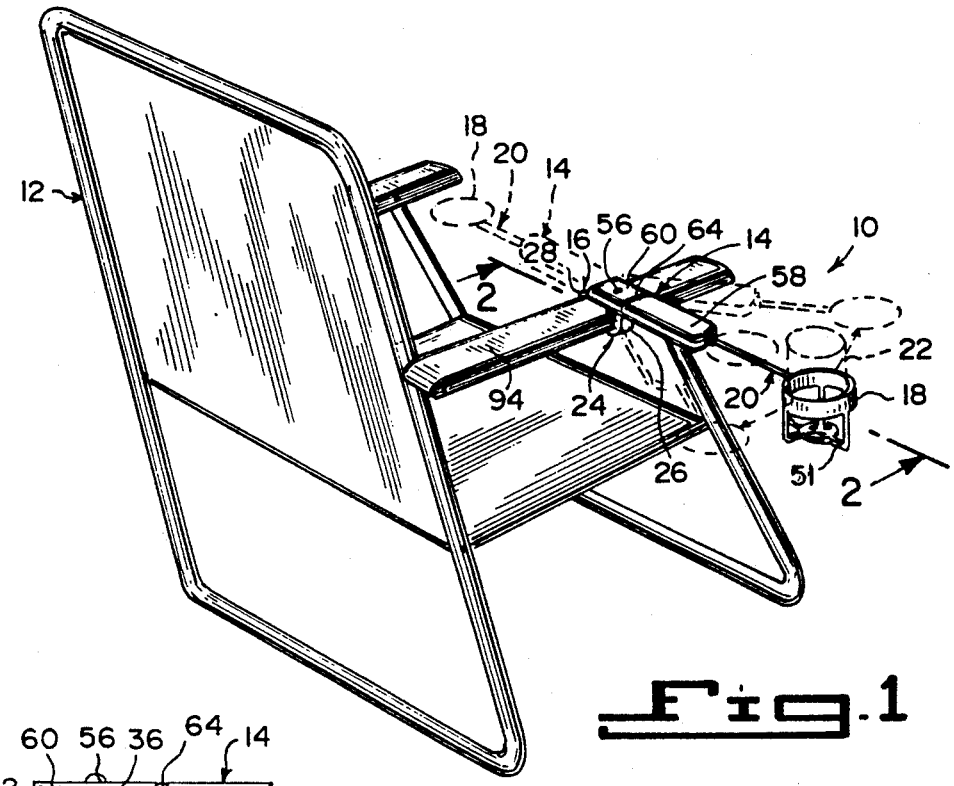
FIG. 1 is a rear perspective view of a folding lounge chair with the instant invention installed thereto ready for use.

Turning now descriptively to the drawings, in which similar reference characters denote similar elements throughout the several views, the Figures illustrate an adjustable beverage holder 10 for a folding lounge chair 12, which consists of an arm 14, a fastener 16 for removably attaching a first end of the arm 14 to the folding lounge chair 12, a beverage receptacle 18 and a mechanism 20 for coupling in an adjustable manner, the beverage receptacle 18 to a second end of the arm opposite from the removable attaching fastener 16. A beverage container 22 placed within the beverage receptacle 18 will be maintained in a steady upright position with respect to the folding lounge chair 12, to prevent spillage from the beverage container 22.

The removable attaching fastener 16 is a clamp 24. The clamp 24 includes a stationary jaw 26 connected to the arm 14. A movable jaw 28 has a portion 30 that slides within the stationary jaw 26. A device 32 is for locking the portion 30 of the movable jaw 28 to the stationary jaw 26.

Figure 2:
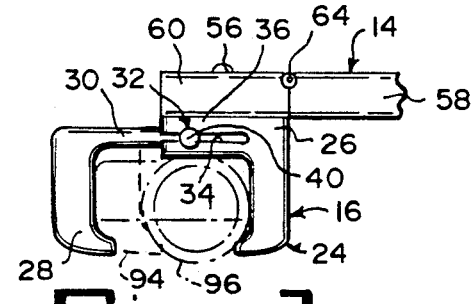
FIG. 2 is an end view with parts broken away taken in direction of line 2—2 in FIG. 1, showing the clamp in greater detail.

As best seen in FIG. 2, the locking device 32 consists of the stationary jaw 28 having a longitudinal slot 34 on one side 36 thereof. A set screw 38 is provided having a threaded shaft and enlarged head 40. The threaded shaft fits through the longitudinal slot 34 and threads into the portion 30 of the movable jaw 28 and is tightened. The enlarged head 40 will bear against the one side 36 of the stationary jaw 26, to lock the movable jaw 28 thereto.

Figure 3:
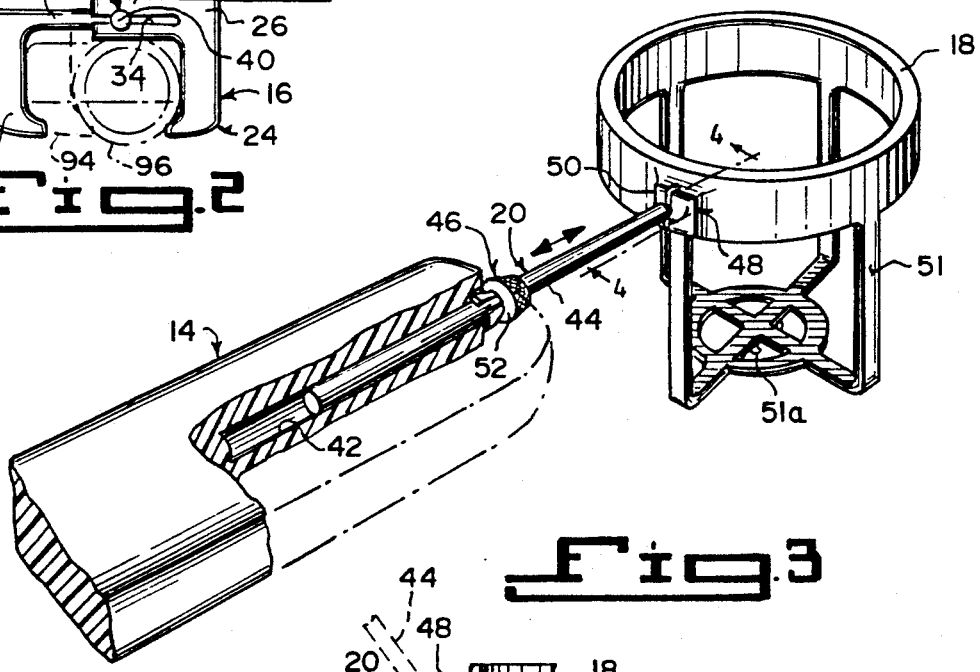
FIG. 3 is an enlarged perspective view with parts broken away and in section, showing the beverage receptacle with an adjustment shaft in greater detail.

As best seen in FIG. 3, the adjustable coupling mechanism 20 includes the arm 14 having a longitudinal aperture 42 extending within the second end. An elongate shaft 44 adjustably fits into the longitudinal aperture 42 and extends outwardly therefrom. An apparatus 46 is for retaining the elongated shaft 44 within the longitudinal aperture 42. A coupler 48 is for pivotally connecting the beverage receptacle 18 to a distal free end of the elongated shaft 44. The beverage receptacle 18 can be positioned in a relative vertical position with respect to the folding lounge chair 12.

Figure 4:
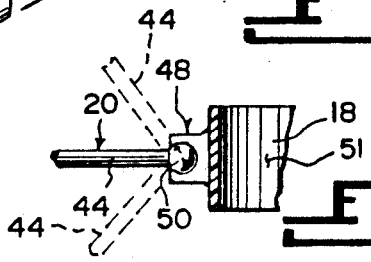
FIG. 4 is a cross sectional view taken along line 4—4 in FIG. 3, showing the ball and socket universal joint in greater detail

The pivotally connecting coupler 48 is a ball and socket universal joint 50, as best seen in FIG. 4. The beverage receptacle 18 is fabricated out of a flexible material 51 such as soft plastic or rubber, so that it can be collapsed for storage. A rotating clip **51*a* is affixed to an underside of the beverage receptacle 18. The rotating clip 51*a* can engage with the elongate shaft 44 when the beverage receptacle 18** is collapsed for storage.

The retaining apparatus 46 is a chuck collar assembly 52, which fits onto the elongate shaft 44 and the longitudinal aperture 42, at the second end of the arm 14. The retaining apparatus 46 can also be a bolt 54, shown in FIG. 8, which threads transversely into the arm 14 at the second end thereof to engage with the elongated shaft 44. A swivel fastener 56 transversely extends into the first end of the arm 14 and the stationary jaw 26 of the clamp 24. The arm 14 can pivot about the clamp 24 to various positions.

As shown in FIGS. 1, 2, 5, 6 and 7, the arm 14 is divided into two segments 58 and 60. The first forward segment 58 is longer in length than the second rearward segment 60. A hinge 64 is between the two segments 58 and 60, so that the first forward segment 58 can be folded up and over the second rearward segment 60 for storage when not in use.

Figures 5, 6, 7, 8, 9:
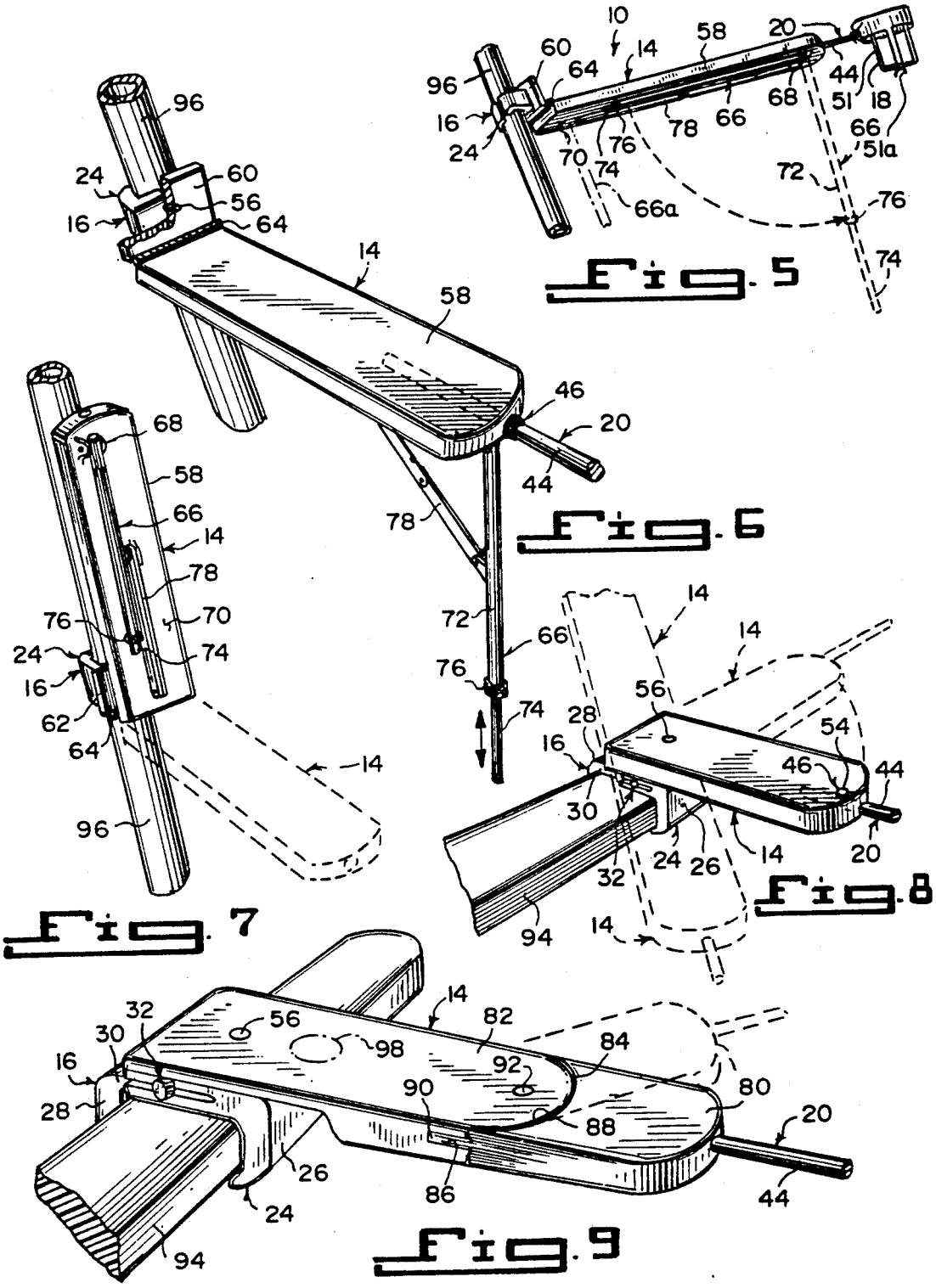
FIG. 5 is a bottom perspective view of a second embodiment of the instant invention attached to the frame of an armless chair, with the collapsible leg ready to be pulled down.
FIG. 6 is a top perspective view of the second embodiment with parts broken away and the collapsible leg down in a support position.
FIG. 7 is a top perspective view similar to FIG. 6, with the arm and the collapsible leg up in a stored position.
FIG. 8 is a top perspective view of a third embodiment with parts broken away attached to an armrest of a chair.
FIG. 9 is a top perspective view of a fourth embodiment with parts broken away attached to an armrest of a chair.

The adjustable beverage holder 10, as shown in FIGS. 5, 6 and 7, further includes a collapsible leg 66 pivotally connected at 68 to a recessed underside 70 of the first forward segment 60 of the arm 14 at the second end thereof. The collapsible leg 66 when extended downwardly in a vertical position will support the arm 14 in a stationary condition.

The collapsible leg 66 contains an upper portion 72 and a lower portion 74 that is telescopic within the upper portion 72. A locking collar 76 is between the upper portion 72 and the lower portion 74, to adjust the length of the collapsible leg 66. The collapsible leg 66 further includes a drop rail support 78, pivotally connected in an angular position between the upper portion 72 of the collapsible leg 66 and the recessed underside 70 of the first forward segment 60 of the arm 14, to help maintain the collapsible leg 66 and the arm 14 in a stationary condition. As shown in phantom in FIG. 5, a second collapsible leg **66*a* identical to the first collapsible leg 66 can be utilized for extra support by being pivotally connected and spaced behind at one side from the first collapsible leg 66**.

The arm 14, as shown in FIG. 9, is divided into two segments 80 and 82, in which the first forward segment 80 is shorter in length than the second rearward segment 82. The second rearward segment 82 has a forward curved edge 84, with a curved groove 86 extending therein. The first forward segment 80 has a rearward curved edge 88, with a curved tongue 90 extending therefrom which rides within the curved groove 86. A second swivel fastener 92 transversely extends into the second rearward segment 82, near the forward curved edge 84 and through the curved tongue 90, so that the first forward segment 80 can pivot thereabout to various positions.

The clamp 24 can be connected to an armrest 94 of the folding lounge chair 12, as shown in FIGS. 1, 2, 8 and 9. If the folding lounge chair 12 is armless, then the clamp 24 can be connected to the frame 96 of the folding lounge chair 12, as shown in FIGS. 2, 5, 6 and 7. As shown in phantom in FIG. 9, an optional hole 98 can also be provided in the second rearward segment 82 for holding an umbrella therein.

The adjustable beverage holder 10 with the hinge 64, as shown in FIGS. 1, 2, 5, 6 and 7, does not need to fold up to store. It can slide back and forth on a backrest portion of the frame 96 or armrest 94 to store.

LIST OF REFERENCE NUMBERS

10—adjustable beverage holder
12—folding lounge chair
14—arm
16—removable attaching fastener
18—beverage receptacle
20—adjustable coupling mechanism
22—beverage container
24—clamp for 16
26—stationary jaw of 24
28—movable jaw of 24
30—portion of 28
32—locking device
34—longitudinal slot in 36
36—one side of 28
38—set screw
40—enlarged head of 38
42—longitudinal aperture in 14
44—elongate shaft
46—retaining apparatus
48—pivotally connecting coupler
50—ball and socket universal joint
51—flexible material for 18
**51*a*—rotating clip on underside of 18**
52—chuck collar assembly for 46
54—bolt for 46
56—first swivel fastener
58—first forward long segment of 14
60—second rearward short segment of 14
64—hinge
66—first collapsible leg
**66*a***—second collapsible leg
68—pivot
70—recessed underside of 60
72—upper portion of 66
74—lower portion of 66
76—locking collar
78—drop rail support
80—first forward short segment of 14
82—second rearward long segment of 14
84—forward curved edge of 80
86—curved groove in 84
88—rearward curved edge
90—curved tongue on 88
92—second swivel fastener
94—armrest of 12
96—frame of 12
98—optional umbrella hole in 82

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An adjustable beverage holder for a folding lounge chair which comprises:

a) an arm b) means for removably attaching a first end of said arm to said folding lounge chair, said removably attaching means is a clamp, said clamp includes a stationary jaw connected to said arm, a movable jaw having a portion that slides within said stationary jaw, and means for locking said portion of said movable jaw to said stationary jaw, said locking means includes said stationary jaw having a longitudinal slot on one side thereof, and a set screw having a threaded shaft and enlarged head, in which said threaded shaft fits through said longitudinal slot and threads into said portion of said movable jaw, and is tightened so that said enlarged head will bear against said one side of said stationary jaw to lock said movable jaw thereto;

c) a beverage receptacle; and d) means for coupling in an adjustable manner, said beverage receptacle to a second end of said arm opposite from said removable attaching means, so that a beverage container placed within said beverage receptacle will be maintained in a steady upright position with respect to said folding lounge chair to prevent spillage from said beverage container, said adjustable coupling means includes said arm having a longitudinal aperture extending within said second end, an elongate shaft which adjustably fits into said longitudinal aperture and extends outwardly therefrom, means for retaining said elongate shaft within said longitudinal aperture, and means for pivotally connecting said beverage receptacle to a distal free end of said elongate shaft, so that said beverage receptacle can be positioned in a relative vertical position with respect to said folding lounge chair.

2. An adjustable beverage holder as recited in claim 1, wherein said pivotally connecting means is a ball and socket universal joint.

3. An adjustable beverage holder as recited in claim 2, further including:

a) said beverage receptacle fabricated out of a flexible material, so that it can be collapsed for storage; and b) a rotating clip affixed to an underside of said beverage receptacle, in which said rotating clip can engage with said elongate shaft when said beverage receptacle is collapsed for storage.

4. An adjustable beverage holder as recited in claim 3, wherein said retaining means is a chuck collar assembly, which fits onto said elongate shaft and said longitudinal aperture at said second end of said arm.

5. An adjustable beverage holder as recited in claim 3, wherein said retaining means is a bolt which threads transversely into said arm at said second end thereof to engage with said elongate shaft.

6. An adjustable beverage holder as recited in claim 3, further including a swivel fastener transversely extending into said first end of said arm and said stationary jaw of said clamp, so that said arm can pivot about said clamp to various positions.

7. An adjustable beverage holder as recited in claim 6, further including:

a) said arm divided into two segments, in which said first forward segment is longer in length than said second rearward segment; and b) a hinge between said two segments, so that said first forward segment can be folded up and over said second rearward segment for storage when not in use.

8. An adjustable beverage holder as recited in claim 7, further including a collapsible leg pivotally connected to an underside of said first forward segment of said arm at said second end thereof, so that said collapsible leg when extended downwardly in a vertical position will support said arm in a stationary condition.

9. An adjustable beverage holder as recited in claim 8, wherein said collapsible leg includes:

a) an upper portion;

b) a lower portion telescopic with said upper portion; and c) a locking collar between said upper portion and said lower portion to adjust the length of said collapsible leg.

10. An adjustable beverage holder as recited in claim 9, wherein said collapsible leg further includes a drop rail support pivotally connected in an angular position between said upper portion of said collapsible leg and said underside of said first forward segment of said arm to help maintain said collapsible leg and said arm in a stationary condition.

11. An adjustable beverage holder as recited in claim 6, further including:

a) said arm divided into two segments, in which said first forward segment is shorter in length than said second rearward segment;

b) said second rearward segment having a forward curved edge with a curved groove extending therein;

c) said first forward segment having a rearward curved edge with a curved tongue extending therefrom which rides within said curved groove; and d) a second swivel fastener transversely extending into said second rearward segment near said forward curved edge and through said curved tongue, so that said first forward segment can pivot thereabout to various positions.

* * * * *